United States Patent [19]

Lendi

[11] 3,969,855

[45] July 20, 1976

[54] MOVABLE PLATFORM FOR PARKING ONE VEHICLE ABOVE ANOTHER

[75] Inventor: Ulrich Lendi, Stafa, Switzerland

[73] Assignee: Mageba S.A., Switzerland

[22] Filed: Aug. 23, 1974

[21] Appl. No.: 500,197

[30] Foreign Application Priority Data

Aug. 25, 1973 Germany ..... 2342987

[52] U.S. Cl. ..... 52/177; 52/78; 52/460

[51] Int. Cl.[2] ..... E04B 5/10

[58] Field of Search ..... 52/74, 78, 460, 463, 52/461, 177

[56] References Cited

UNITED STATES PATENTS

| | | | |
|---|---|---|---|
| 690,121 | 12/1901 | Rendle | 52/463 |
| 705,491 | 7/1902 | Van Noorden | 52/460 |
| 1,090,186 | 3/1914 | Yauch | 52/461 |
| 3,054,483 | 9/1962 | Pieri | 52/15 |
| 3,169,346 | 2/1965 | Sklar | 52/15 |
| 3,327,443 | 6/1967 | Gay | 52/460 |
| 3,388,510 | 6/1968 | Smith | 52/15 |
| 3,423,891 | 1/1969 | Burris | 52/15 |
| 3,844,087 | 10/1974 | Schultz | 52/463 |

FOREIGN PATENTS OR APPLICATIONS

| | | | |
|---|---|---|---|
| 524,168 | 5/1931 | Germany | 52/463 |

*Primary Examiner*—Ernest R. Purser
*Assistant Examiner*—Henry Raduazo
*Attorney, Agent, or Firm*—William A. Drucker

[57] ABSTRACT

A parking platform for automobiles in which the flooring is supported by cross members secured at each end to struts having vertical walls, the ends of the struts of which the flooring is comprised are turned down into slits in the transverse members. The flooring is held down by a plate which bridges the ends of adjacent flooring strips the plate being secured to a stirrup within the transverse members.

6 Claims, 4 Drawing Figures

MOVABLE PLATFORM FOR PARKING ONE VEHICLE ABOVE ANOTHER

The invention relates to a movable platform for parking one vehicle above another, comprising longitudinally extending struts, which form a rigid carrier frame with transverse carriers disposed in spaced arrangement, also comprising metal base plates covering the carrier frame in a water-tight manner.

A known platform of this type comprises lateral struts constructed as drive channels, metal base plates being laid on the edges disposed on the interior of the platform, which overlap on their end regions, as viewed in the direction of travel. These loosely laid metal base plates clatter when driving over the beams; the metal base plates can easily split, such that open crevices occur through which water can drip onto the members beneath.

In a further known platform the metal base plates cover the entire carrier frame and are secured thereon by means of screws. Even with additional sealing of the screw holes, the penetration of water through the screw connection, dripping onto the members beneath, cannot be avoided in the long-term. Metal base plates connected by screws have the further disadvantage that the screw holes can either only be bored at the place of mounting or, with previously produced bores, narrow tolerances must be observed.

The invention is based on the aim of providing a platform of the afore-mentioned type, wherein the drainage of water is regulated.

According to the invention, this aim is attained in that the metal base plates are joined to each other without overlapping and, on their curved end edges, engage in interstices of the profile walls, disposed adjacent the metal base plates, of the parts of the support frame constructed with a hollow section.

In this manner, drainage of the metal base plates via the interstices into the interior of the hollow profiles of the support frame, is obtained. The water collected there can then flow away in conformity with the inclined position of the platform and can be intercepted on leaving the hollow profiles in any manner desired. Since the curved end edges of the metal base plates engage in the interstices, precise dimensioning of the metal base plates is not necessary, owing to the width of these interstices. According to the interstice width in each case, arbitrarily wide tolerance margins are possible.

Within the scope of this inventive idea the metal base plates can be bevelled on every side and can engage in slotted hollow profiles of the parts forming the carrier frame in both the transverse and longitudinal sense.

In a preferred embodiment of the invention comprising two longitudinally extending lateral struts, which form a rigid carrier frame with the transverse carriers disposed in spaced arrangement, and also comprising metal base plates covering the support frame in a water-tight manner, the arrangement is such that the metal base plates extend substantially over the entire width of the platform, are joined to each other without overlapping, and, with the curved end edges of their transversally extending margins, engage in interstices of the profiled wall disposed adjacent the metal base plates, of the transverse carriers constructed so as to have a hollow profile in cross-section. Furthermore, the metal base plates can be secured on the carrier frame by means of clamp connections. These clamp connections can be disposed at any desired point.

The hollow section can thereby be substantially C-shaped. According to a particularly advantageous embodiment having independent inventive value, the arrangement is such that each clamp connection comprises a clamping plate, which reaches over the transversally extending margins of two successive metal base plates and which is adapted to be tensioned on the transverse carrier supporting the margins of the two metal base plates by means of a clamp stirrup which is to be disposed in the interior of the slotted transverse carriers. A screw, which is integral with the clamp stirrup and passes through the clamping plate, is advantageously provided for tensioning of the clamp stirrup and tension plate; on tightening this screw, the ends of the clamp stirrup are supported on the internal surfaces of the limbs, adjoining the interstice, of the associated transverse carrier profile.

At least two clamp connections are advantageously provided for each slotted transverse carrier, for the purpose of securing the metal base plates disposed in position thereon.

For drainage of the slotted transverse carriers, it has been proposed that the longitudinally extending struts can be constructed as profiled carriers comprising a wall, which defines the platform laterally, is disposed vertically relative to the plane of the platform and to which a U-bar, open in the direction of the under surface of the platform, is connected. The water collected in the slotted transverse carriers travels through bores in the end regions of the transverse carriers in the profiled wall disposed opposite the interstice into the afore-mentioned U-bars of the lateral struts and can then be drained. The water collected on the metal base plates flows laterally over the metal base plates into the U-bars of the lateral struts of the platform.

The metal base plates can be of substantially level construction. To increase their resistance to slip, they can comprise grooves, extending transversally relative to the platform and projecting on one side or on both sides in an alternating manner.

Further details and features of the invention are disclosed in claims 9 to 13.

An embodiment of the invention is illustrated in the drawings, in which.

Figure 1:
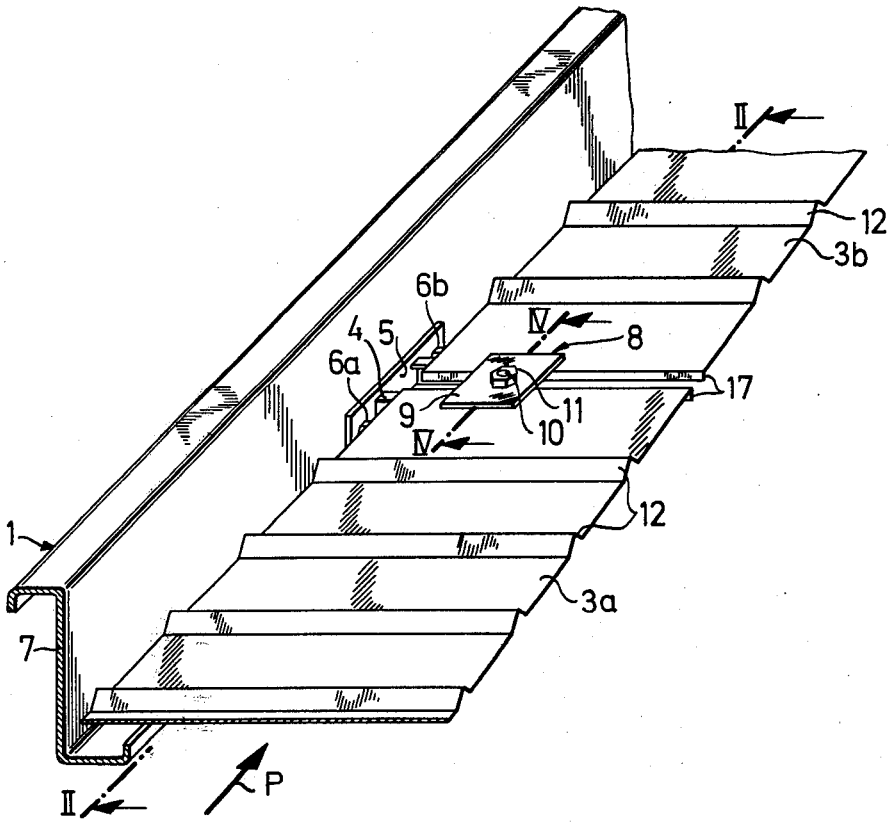
FIG. 1 shows part of the platform in perspective view.
Figure 4:
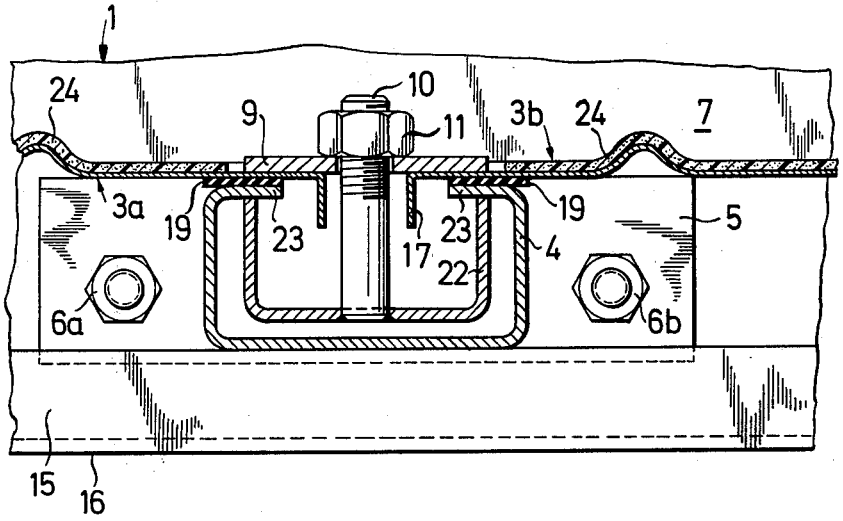
FIG. 4 is a partial longitudinal section of the platform, taken along the line IV—IV of FIG. 1, comprising a clamp connection, on an enlarged scale.

In FIG. 1 the upper part of a strut 1 can be seen and also metal base plates 3*a* and 3*b* positioned one behind the other in the direction of travel P over the platform. The metal base plates are supported in the vicinity of their adjacent, transversally extending edges by means of the C-shaped transverse carrier 4, which is partially visible and the frontal end of which is welded to the flange 5. The flange 5 is secured on the vertical wall 7 of the strut 1 by means of screws 6*a*, 6*b*. The curved end edge 17 of the metal base plate 3*b* projects into the interior of the C-profile, which is slotted on the upper surface, of the transverse carrier 4; similarly the curved end edge, which is not visible, of the metal base plate 3*a*. The metal base plates 3*a* and 3*b* are tensioned down onto the transverse carrier 4 by means of the clamp connection 8. Of the clamp connection shown on a larger scale in FIG. 4, FIG. 1 shows only the clamping plate 9, disposed on the margins of the metal base plates 3*a*, 3*b* the end, projecting through the clamping plate, of the screw 10, connected to the clamp stirrup, which is not visible, and the nut 11. The two metal base plates comprise transversally extending grooves 12, which are stamped out in the upward sense and improve the resistance to slip of the metal base plates.

Figure 2:
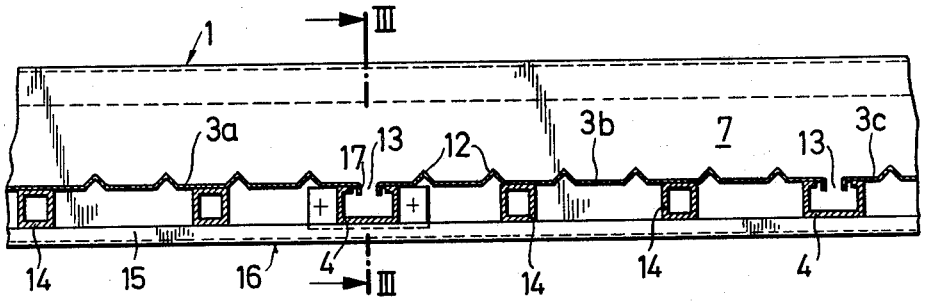
FIG. 2 is a longitudinal section of the platform, taken along the line II—II of FIG. 1.

FIG. 2 is a view of the surface disposed on the interior of the platform of the vertical wall 7 of the strut 1. The metal base plates 3*a*, 3*b* and 3*c* are disposed on transverse carriers, which are shown in section. The metal base plates are each supported by a slotted transverse carrier 4 at the ends. The slotted transverse carriers 4 have a C-shaped cross-sectional profile with a slotted upper profiled wall. The curved end edges 13 of the profiled metal plates project into the interstice 13 of each of these transverse carriers. Furthermore, transverse carriers 14 with a closed hollow profile are provided for support of the metal base plates. All the transverse carriers are disposed on the upwardly directed limb 15 of a U-bar 16 forming the lower part of the strut 1. Upwardly projecting bevelled grooves 12 are mounted on the metal base plates to increase their grip capacity.

Figure 3:
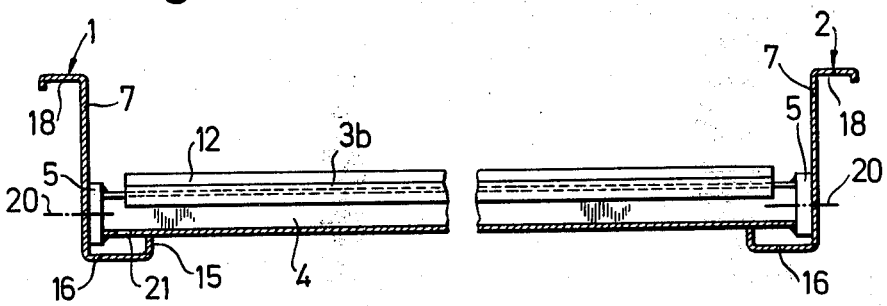
FIG. 3 is a cross-section of the platform, taken along the line III—III of FIG. 2.

The exact profiled shape of the struts 1 or 2 is apparent from the reduced cross-section of the platform according to FIG. 3. These struts substantially enclose a vertical wall 7, a U-bar 16 forming a downward continuation of the vertical wall and an upper margin 18, which is curved in the downward sense. The transverse carriers are screwed on the interior surface of the wall 7 by means of the flanges 5. The screw connection is indicated by the dash-dotted line 20. The transverse carriers are welded to the flanges 5 at both ends.

A slotted transverse carrier 4 with the metal base plates 3*a* and 3*b* positioned thereon is illustrated in FIG. 3. Above the U-bar 16, the lower profiled wall of the transverse support 4 comprises a bore 21. Rain water, which collects on the metal base plates, travels through the interstice 13 into the interior of the transverse supports 4 and flows out of them through the bores 21 into the U-bars 16 of the struts 1, and is conducted away at the ends thereof.

FIG. 4 shows the clamp connection, on an enlarged scale, between two metal base plates 3*a*, 3*b* disposed one behind the other. The clamp connection consists of the clamping plate 9, clamp stirrup 22, screw 10 and the nut 11. The screw 10 is welded to the clamp stirrup 22 on its lower end. On tightening the nut 11, the two ends of the clamp stirrup are urged against the interior surface of the limbs 23, adjoining the interstice 13, in accordance with the C-shaped cross-sectional profile of the transverse supports 4. The transverse support 4 is welded, on its end, to the flange 5, which is secured to the vertical wall 7 of the strut 1 by means of screws 6*a* and 6*b*.

The transverse support 4 is disposed with its under surface on the edge of the upwardly directed limb 15 of the U-bar 16 of the strut 1 and is secured on the strut 1 by means of the flange 5. The layers of rubber 19, which are indicated in FIG. 4, can be inserted between the metal base plates 3*a*, 3*b* and the limbs 23 of the transverse support 4 to provide additional clamping action.

The metal base plates 3*a*, 3*b* are provided with a covering layer 24.

I claim:

1. A platform assembly, for use in apparatus for parking one vehicle above another, comprising:

*i.* two transversely-spaced longitudinal struts, each strut including a vertical wall, a first flange extending outwardly from the upper edge of said vertical wall, a second flange extending inwardly from the lower edge of said vertical wall and having an upwardly extending free end;

*ii.* a plurality of transverse members disposed in spaced relationship and extending between said struts, said transverse members being rectangular hollow section members with a longitudinal slot in the top wall thereof, said transverse members overlying at each end the second flange of a respective strut, said transverse members having at each end a flange secured to the vertical wall of the respective strut, said transverse members having a drainage aperture adjacent each end in the portion thereof overlying the second flange;

*iii.* a plurality of metal base plates disposed on said transverse members in a row longitudinally of the struts, said base plates extending transversely for substantially the entire width between the vertical walls of the two struts, said base plates having at each of their transverse edges a downwardly bent edge portion engaging into the slot of a transverse member, said base plates at least partially overlying said second flange and being of a length not greater than the length of said transverse members.

2. A platform assembly, as claimed in claim 1, comprising clamp means for securing said metal base plates on said transverse members.

3. A platform assembly, as claimed in claim 2, wherein said clamp means comprises a clamping plate spanning edge portions of two adjacent metal base plates, a stirrup member of inverted U-shaped cross-section disposed within the transverse member with its upturned ends being against the internal surface of the transverse member on both sides of and adjacent the slot, and tightening means connecting said clamping plate and said stirrup.

4. A platform assembly, as claimed in claim 3, wherein said tightening means is a threaded rod integral with said stirrup and extending through said clamping plate and receiving a tightening nut.

5. A platform assembly, as claimed in claim 2, wherein at least two clamp means are provided on each transverse member.

6. A platform assembly, as claimed in claim 1, wherein the metal base plates have upwardly projecting transverse ribs.

* * * * *